US009675213B2

(12) United States Patent
Parikh et al.

(10) Patent No.: US 9,675,213 B2
(45) Date of Patent: Jun. 13, 2017

(54) LIVING HINGE CREATION THROUGH VACUUM FORMING OF A THERMOFORMABLE PLASTIC SHEET

(75) Inventors: Nirav D. Parikh, Sylvania, OH (US); Michael Glenn Geels, Jackson, TN (US)

(73) Assignee: Delta Faucet Company, Indianapolis, IN (US)

( * ) Notice: Subject to any disclaimer, the term of this patent is extended or adjusted under 35 U.S.C. 154(b) by 1020 days.

(21) Appl. No.: 13/883,999

(22) PCT Filed: Sep. 2, 2011

(86) PCT No.: PCT/US2011/050366

§ 371 (c)(1),
(2), (4) Date: May 8, 2013

(87) PCT Pub. No.: WO2012/067699

PCT Pub. Date: May 24, 2012

(65) Prior Publication Data

US 2013/0219612 A1 Aug. 29, 2013

Related U.S. Application Data

(60) Provisional application No. 61/413,575, filed on Nov. 15, 2010.

(51) Int. Cl.
*A47K 3/02* (2006.01)
*A47K 3/04* (2006.01)
(Continued)

(52) U.S. Cl.
CPC ..... *A47K 3/04* (2013.01); *A47K 3/02* (2013.01); *A47K 3/16* (2013.01); *A47K 3/30* (2013.01);
(Continued)

(58) Field of Classification Search
USPC ..... 4/608, 612, 614
See application file for complete search history.

(56) References Cited

U.S. PATENT DOCUMENTS 3,454,694 A * 7/1969 Peace ..... B29C 53/06 264/151
3,494,092 A * 2/1970 Bottjer ..... E04B 1/04 52/125.4
(Continued)

OTHER PUBLICATIONS

International Search Report from PCT/US11/50366, dated Feb. 8, 2012.

*Primary Examiner* — Lauren Crane
(74) *Attorney, Agent, or Firm* — Carlson, Gaskey & Olds, PC

(57) ABSTRACT

A bathing vessel is made of a segmented sheet wall of layered materials that includes a first layer of polyurethane material, a second layer of polyurethane material attached to the first layer, a third layer of acrylonitrile butadiene styrene (ABS) material attached to the second layer, and a fourth layer of acrylic material attached to the third layer. The segmented sheet wall has a width a length and a first thickness. The segmented sheet wall has an integral first portion having a second thickness that is that is thinner than the first thickness. The first portion defines a first wall and a second wall in the segmented sheet wall and the first portion is corrugated.

17 Claims, 3 Drawing Sheets

(51) Int. Cl.

| | |
|---|---|
| ***A47K 3/30*** | (2006.01) |
| ***B05D 3/12*** | (2006.01) |
| ***A47K 3/16*** | (2006.01) |

(52) U.S. Cl.
CPC ..... *B05D 3/12* (2013.01); *Y10T 29/49* (2015.01); *Y10T 29/49826* (2015.01)

(56) References Cited

U.S. PATENT DOCUMENTS

| | | | | |
|---|---|---|---|---|
| 3,751,737 | A | 8/1973 | Mustee | |
| 4,067,071 | A | 1/1978 | Altman et al. | |
| 5,363,616 | A | 11/1994 | Hernandez | |
| 6,824,860 | B2 | 11/2004 | Edwards et al. | |
| 7,690,321 | B2 * | 4/2010 | Karow ..... | E01F 13/02 116/63 P |
| 7,774,991 | B2 | 8/2010 | Fletcher et al. | |
| 2005/0281997 | A1 * | 12/2005 | Grah ..... | B32B 7/02 428/215 |
| 2007/0251183 | A1 | 11/2007 | Thiagarajan et al. | |

* cited by examiner

LIVING HINGE CREATION THROUGH VACUUM FORMING OF A THERMOFORMABLE PLASTIC SHEET

RELATED APPLICATION

This application claims priority to U.S. Provisional Application No. 61/413,575, which was filed Nov. 15, 2010.

BACKGROUND

Typically to extrude bath surrounds or other parts, raw material is fed into a feed hopper which in turn provides a screw that passes from material through a heater. The material is pushed through a die and then may be pushed through coating equipment and extruded towards a trim knife. The cooling material is frequently passed through pull rollers.

Bath surrounds for tubs or for showers are usually one piece or several pieces. The one piece surrounds typically have two sidewalls and a back wall. Such one piece construction is problematic in that it is sometimes difficult to handle, difficult to get into a bathroom and expensive to ship because of the odd shapes that are not always nestable. They are also subject to damage while being handled.

To overcome these problems, surrounds may be created with three separate parts or two separate parts. The three part surrounds include a separate sidewall and a separate back portion. These walls can then be easily stacked and packed and shipping is easier as is placing the product into the bathroom for installation. However, many designs require that the corners be mated carefully such that leakage does not occur between or within seams between the sidewalls and the back wall. Also, caulk is usually used to seal the joints so that leakage does not get behind the walls thereof.

Bathing vessels may be manufactured from a variety of different materials, such as plastic materials. Plastic bathing vessels, however, must meet certain minimum performance requirements. For instance, the American National Standards Institute (ANSI) sets forth minimum physical requirements and testing methods for plastic bathtub and shower units. A bathing vessel that meets the requirements is approved for use in homes, buildings or other structures as a plumbing fixture.

SUMMARY

According to an embodiment disclosed herein, a bathing vessel is made of a segmented sheet wall of layered materials that include a first layer of polyurethane material, a second layer of polyurethane material attached to the first layer, a third layer of acrylonitrile butadiene styrene (ABS) material attached to the second layer, and a fourth layer of acrylic material attached to the third layer. The segmented sheet wall has a width a length and a first thickness. The segmented sheet wall has a first portion having a second thickness that is that is thinner than the first thickness. The first portion defines a first wall and a second wall in the segmented sheet wall and the first portion is corrugated.

According to a further embodiment disclosed herein, a bathing vessel is made of a segmented sheet wall of layered materials that include a first layer of polyurethane material, a second layer of polyurethane material attached to the first layer, and a third layer of acrylonitrile butadiene styrene (ABS) material attached to the second layer. The bathing vessel wall has a width a length and a first thickness. The segmented sheet wall has a first portion having a second thickness that is that is thinner than the first thickness. The first portion defines a first wall and a second wall in the segmented sheet wall and the first portion is contoured so that contour stretches apart for shipping or handling and collapses for installation.

According to a further embodiment disclosed herein, a method of constructing a bathing vessel includes providing a sheet wall of layered materials, which has a first layer of polyurethane material, a second layer of polyurethane material attached to the first layer, and a third layer of acrylonitrile butadiene styrene (ABS) material attached to the second layer, wherein the wall has a width a length and a first thickness. Other steps include segmenting the sheet wall into a first wall and a second wall by thinning a first portion of the sheet wall between the first wall and the second wall, and contouring the first portion such that the first portion stretches during shipping and handling and storing and compresses during installation.

These and other features of the present invention can be best understood from the following specification and drawings, the following of which is a brief description.

DETAILED DESCRIPTION

Figure 1:
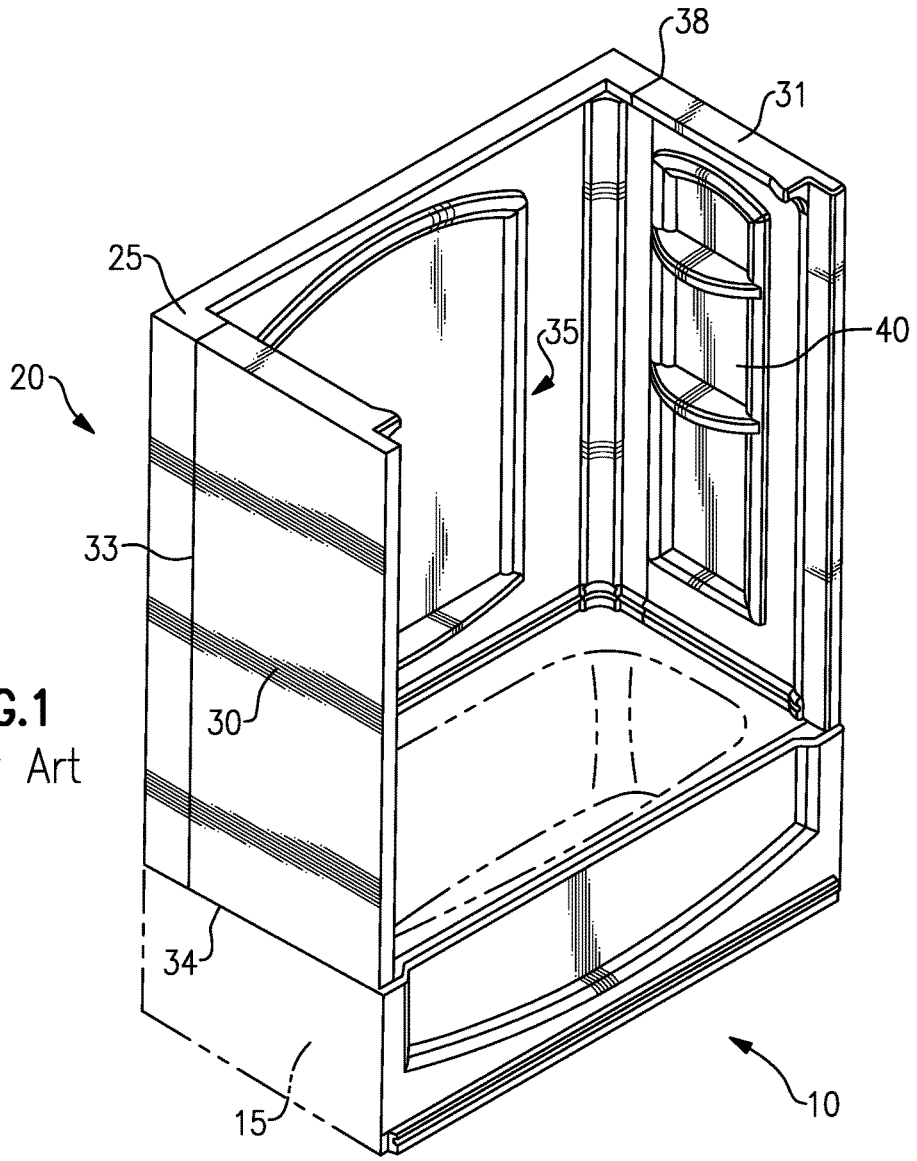
FIG.1 Prior Art
FIG. 1 is a prior art version of a tub surround.

Referring to FIG. 1, a typical prior art view of a one piece bathing vessel 10 includes a tub 15 and a surround 20 having three pieces comprising a sidewall 30, sidewall 31 and back wall 25 as shown. In this embodiment, the sidewalls 30 and 31 are connected to the back wall 25 at seams 33. Seam 34 connects the sidewalls 30, 31 and the back wall 25 to the tub. Some surrounds known in the prior art are shipped in one piece without seams 33 and without seams 34.

Figure 2:
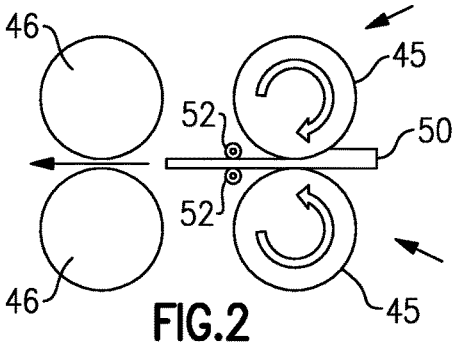
FIG. 2 is a side view of an extrusion die rollers that are used to construct a panel for use in a shower enclosure.
Figure 3:
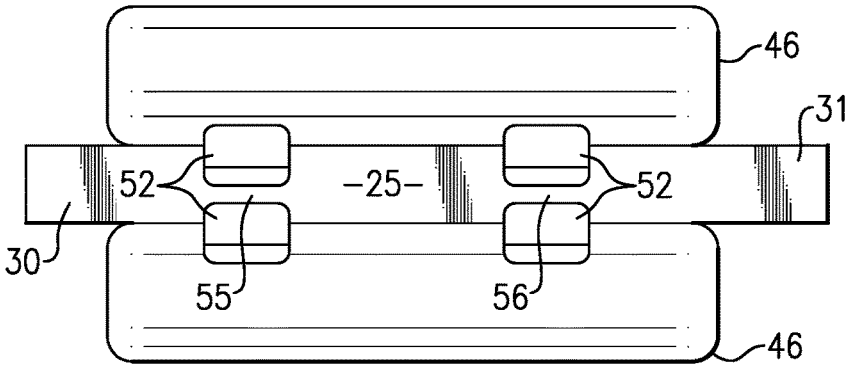
FIG. 3 is a back view of the extrusion die rollers of FIG. 2.

Referring now to FIGS. 2 and 3, material 50 is extruded through extrusion rollers 45 and is pulled after extrusion by pulling rollers 46, a pair of hinge rollers 52 are impressed into the material 50 to create grooves 55, 56 or narrowed portions that become living hinges of a shower surround 20. The rollers 52 are spaced apart such that the edges of the extruded material, after a cutting process (not shown), become surround walls 30, 31 and the area between the rollers 45 becomes the back wall 25. Though not shown to scale, one of the hinge rollers 52 may be narrower or wider than the other such that the grooves 55, 56 may be of different widths. By modifying placement of the hinge rollers 52, towards or away from each other along a width of the material 50 downstream of the extrusion rollers 45, the width of the back portion 25 and the width of the side portions 30, 31 may be modified. Though two hinge rollers 52 are shown, more or fewer hinge rollers may be necessary. For instance, if a bathing vessel, such as a shower enclosure only needs two walls (the rest may be glass or a curtain) only one hinge roller is necessary. Similarly, if more bends are required for a more complex surround 20 more hinge rollers 52 may be provided. Furthermore, other types of rollers or presses may be used to create the narrowed portions 55, 56.

Figure 4:
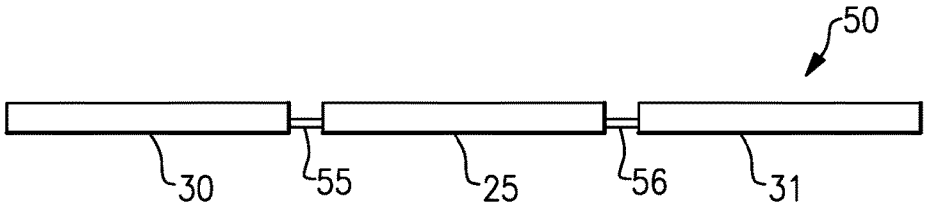
FIG. 4 is a top or a bottom view of the wall sections of a bath surround after being subjected to the rollers of FIG. 3.

Referring now to FIG. 4, a side view of the wall material 50 after it passes through the hinge rollers 52 is shown. The material 50 is a straight section having sidewalls 30, 31, and back wall 25 joined by living hinges 55, 56. The material 50 is ready for shipping and/or storage.

Figure 5:
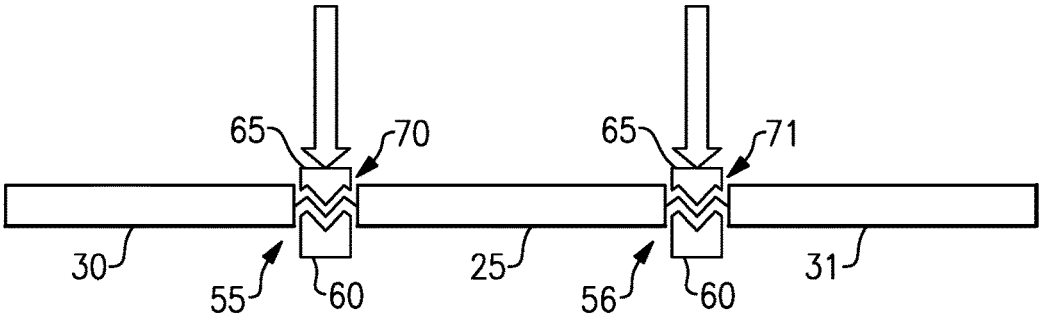
FIG. 5 shows the wall sections of FIG. 4 experiencing further processing.

Referring to FIG. 5, the narrowed (e.g., thinner) portions 55, 56 are subject to a compressive force provided to the narrowed portions by jaws 60 and 65 that create an M-shaped (i.e., corrugated-shaped) joint 70 out of the narrowed portions. While an M-shaped joint is shown, one of ordinary skill in the art will recognize from the teachings herein, that other shaped joints are contemplated herein. Essentially the jaws. 60, 65 create a contour (not a straight line) that flexes or expands so that when extra length in the hinges 70, 71 is required as during shipping and handling, the hinge is stretched or expanded to utilize a length of the hinges 70, 71 that is stored in the contour. If the surround is to be installed, the utilized extra length (see FIG. 6) can be stowed back in the contour which may compress even further due to the flexibility of the material 50 used and discussed infra. One of ordinary skill in the art will recognize that, given the material used, the use of narrowed portions, such as portions 55, 56, may not be necessary to provide a contoured surface that may be flexed as taught herein.

Figure 5A:
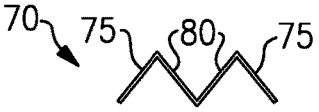
FIG. 5A shows the details hinge of FIG. 4.

Referring to FIG. 5A, detail of the joint 70 is shown. The M-shaped joint has a pair of legs 75 that are connected to each other by a pair of inner legs 80 that are angled to each side 75 and to each other. The living hinges 70, 71 can bend around the joints between each other and between the connection to the walls 31, 30 and back wall 25. The legs 75 may be thicker than the legs 80 by varying the shape of the jaws 60, 65 to create stiffer portions of the living hinges 70, 71.

Figure 6:
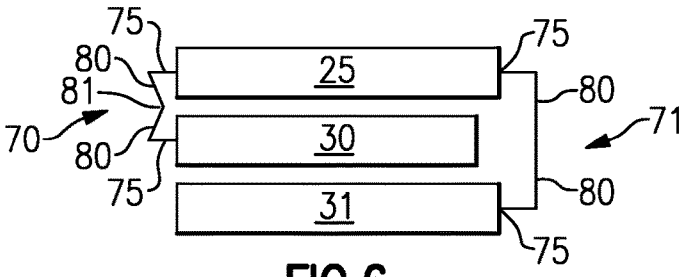
FIG. 6 shows a top view of the wall sections of FIG. 5 in a stored position for shipping.

Referring now to FIG. 6, a stowed view of the walls 30, 31 and the back wall 25, for shipping, handling and storage is shown. In this position, wall 30 is bent in close proximity or touching back wall 25. The hinge 70 allows the walls 75 to become almost parallel to each other and the inner walls 80 to flatten a corrugation 81 therebetween to allow the wall 30 to bend towards the back wall 25. Similarly, hinge 71 requires the walls 75 to become almost parallel or to bend slightly towards each other and the inner walls 80 to flatten towards 180° degrees to allow wall 31 to bend in close proximity or touching the wall 30 to create a compact package for shipping handling and storage. The thicker width of legs 80 makes bending of the thinner legs 75.

Figure 7:
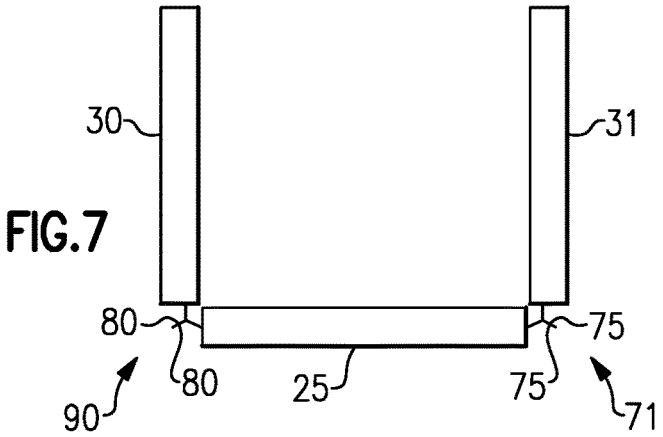
FIG. 7 shows a top view of the wall sections of FIG. 6 in a deployed position.

Referring to FIG. 7, the wall sections 30, 31 and 25 are shown in a deployed position for positioning upon a bathing vessel 10. In this position, the inner walls 80 are joined to each other so that the walls 30, 31 and 25 are in close proximity to each other to minimize the amount of caulking required. If the sidewalls 30, 31 are at right angles, or the like, to the back wall 25, the hinges have sections 75 that collapse upon each other. Legs 75 form an obtuse angle at their joint. Note that because of the proximity of the walls 30, 31 and 25, any leakage behind the walls is stopped by the hinges 55, 56 from leaking behind surround 20.

Figure 8:
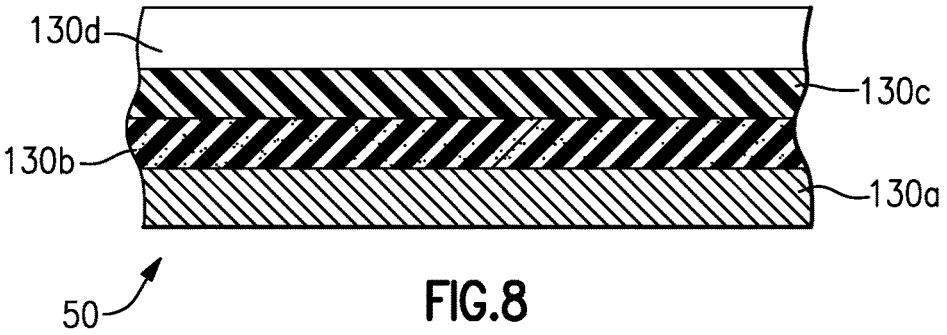
FIG. 8 shows a side view of the structure of the wall sections.

FIG. 8 shows a cross-section through a portion of one of the walls 25, 30, 31 that are a multi-layer structure (i.e., material 50) that generally includes a first layer of polyurethane material 130*a*, a second layer of polyurethane material 130*b*, a layer of acrylonitrile butadiene styrene (ABS) material 130*c*, and a layer of acrylic material 130*d* (collectively layers 130*a-d*), such as polymethylmethacrylate. As shown, the layer of acrylic material 130*d* is a top layer and is exposed for view to a user within the bathing vessel 10. The layers 130*b* and 130*c* are intermediate layers, and the layer 130*a* is a bottommost layer that is generally obscured from view of a user within the bathing vessel 10. Each of the layers 130*a-d* is bonded to its respective neighboring layer or layers. In embodiments, the specific materials and order of the layers 130*a-d* contributes to providing the bathing vessel with a desired degree of strength, such as to meet ANSI requirements.

In embodiments, the layer of acrylic material 130*d* is arranged on the first layer of polyurethane material 130*a*, the layer of acrylonitrile butadiene styrene (ABS) material 130*c* is arranged between the layer of acrylic material 130*d* and the first layer of polyurethane material 130*a*, and the second layer of polyurethane material 130*b* is arranged between the layer of ABS material 130*c* and the first layer of polyurethane material 130*a*. In some examples, additional layers may be arranged among the layers 130*a-d*. In other examples, the walls 25, 30, 31 include only the layers 130*a-d* and are free of other layers, materials, adhesives, or the like.

The thicknesses of the individual layers 130*a-d* is not necessarily shown to scale and may vary, depending on the desired wall strength and location in the wall 25, 30, 31, for example. In embodiments, the ratio of the thickness of the layer of acrylic material 130*d* to the thickness of the layer of ABS material is no greater than 1, to facilitate meeting strength requirements.

In embodiments, the first layer of polyurethane material 130*a*, the second layer of polyurethane material 130*b*, or both, are foamed polyurethane materials. In some examples, the density of the first layer of polyurethane material 130*a* is different than the density of the second layer of polyurethane material 130*b*. For instance, the density of the first layer of polyurethane material 130*a* is greater than the density of the second layer of polyurethane material 130*b*, to facilitate achievement of a desired degree of strength of the walls 24.

In a further example, the second layer of polyurethane material 130*b* is a rigid layer and has a density of 1-10 pounds per cubic foot. The first layer of polyurethane material 30*a* is an elastomeric layer and has a density of about 25-65 pounds per cubic foot though in some examples approximately 55-65 pounds per cubic foot are used. In one example, the density is approximately 62 pounds per cubic foot.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A bathing vessel, said bathing vessel comprising:

a segmented sheet wall of layered materials, said layered materials including;

a first layer of polyurethane material, a second layer of polyurethane material directly attached to said first layer, a third layer of acrylonitrile butadiene styrene (ABS) material directly attached to said second layer, and a fourth layer of acrylic material directly attached to said third layer, wherein said segmented sheet wall has a width, a length, and a first thickness; and wherein said segmented sheet wall has a first integral portion having a second thickness that is that is thinner than said first thickness, said first integral portion defining a first wall and a second wall in said segmented sheet wall as said first integral portion bends such that said first and second wall form at least a portion of a bathing vessel surround, and wherein said first integral portion is corrugated, and wherein said acrylic material comprises polymetheyl methacrylate that provides an external and visible wall surface of the bathing vessel surround.

2. The bathing vessel of claim 1 wherein said segmented sheet wall has a second portion having a third thickness that is thinner than said first thickness, said second portion defining a third wall relative to said second wall in said segmented sheet wall as said second portion bends and wherein said second portion is corrugated, and wherein said first, second, and third walls form the bathing vessel surround when the first integral portion and the second portion are bent.

3. The bathing vessel of claim 1 wherein said second portion is M-shaped.

4. The bathing vessel of claim 3 wherein upon bending said second portion, said third wall is proximate to said second wall.

5. A bathing vessel, said bathing vessel comprising:

a segmented sheet wall of layered materials configured to form a bathing vessel surround, said layered materials including;

a first layer of polyurethane material, a second layer of polyurethane material directly attached to said first layer, and a third layer of acrylonitrile butadiene styrene (ABS) material directly attached to said second layer, wherein said wall has a width, a length, and a first thickness, a fourth layer directly attached to said third layer, and wherein said fourth layer comprises an acrylic material that provides an external and visible wall surface of said bathing vessel surround, and wherein said segmented sheet wall has a first portion having a second thickness that is that is thinner than said first thickness, said first portion defining a first wall and a second wall in said segmented sheet wall as said first portion bends and wherein said first portion has a contour, and wherein said contour is stretched for shipping or handling and collapsed for installation.

6. The bathing vessel of claim 5 wherein said contour further comprises at least:

a first leg attaching to and integral with the first wall and a second leg attaching to and integral with said first leg, said second leg bending around said first leg.

7. The bathing vessel of claim 5 wherein said first leg is thicker than said second leg.

8. The bathing vessel of claim 6 wherein said contour further comprises:

a third leg attaching to and integral with said second leg, and a fourth leg attaching to and integral with said third leg and attaching to and integral with said second wall, said third wall bending around said fourth leg, and wherein said second wall and said third wall bend relative to each other.

9. The bathing vessel of claim 5 wherein said fourth leg is thicker than said third leg.

10. A bathing vessel, said bathing vessel comprising:

a sheet wall of layered materials configured to form a bathing vessel surround, said layered materials including;

a first layer of polyurethane material, a second layer of polyurethane material directly attached to said first layer, a third layer of acrylonitrile butadiene styrene (ABS) material directly attached to said second layer, a fourth layer of acrylic material directly attached to said third layer, and wherein said fourth layer provides an external and visible wall surface of the bathing vessel surround, and wherein said sheet wall has an integral contoured portion, said integral contoured portion defining a first wall and a second wall in said sheet wall as said integral contoured portion flexes.

11. The bathing vessel of claim 10 wherein said integral contoured portion further comprises:

a first leg attaching to and integral with the first wall, and a second leg attaching to and integral with said first leg, said second leg bending around said first leg.

12. The bathing vessel of claim 11 wherein said first leg is thicker than said second leg.

13. The bathing vessel of claim 11 wherein said integral contoured portion further comprises:

a third leg attaching to and integral with said second leg, and a fourth leg attaching to and integral with said third leg and attaching to and integral with said second wall, a third wall bending around said fourth leg and wherein said second wall and said third wall bend relative to each other.

14. The bathing vessel of claim 13 wherein said fourth leg is thicker than said third leg.

15. The bathing vessel of claim 10 wherein said sheet wall has a second contoured portion defining a third wall relative to said second wall in said sheet wall as said second contoured portion bends, and wherein said first wall comprises a first bathing vessel side wall, said third wall comprises a second bathing vessel side wall facing opposite said first bathing vessel side wall, and said second wall comprises a bathing vessel back wall extending between said first and second bathing vessel side walls.

16. The bathing vessel of claim 15 wherein said sheet wall is collapsible into a shipping, handling, or storage position wherein one of said first and second bathing vessel side walls is bent around and underneath said bathing vessel back wall and the other of said first and second bathing vessel side walls is bent around and underneath the one of said first and second bathing vessel side walls such that both bathing vessel side walls and the bathing vessel back wall are in a stacked arrangement.

17. The bathing vessel of claim 1 wherein said segmented sheet wall has a contoured portion defining a third wall relative to said second wall in said segmented sheet wall as said contoured portion bends, and wherein said first wall comprises a first bathing vessel side wall, said third wall comprises a second bathing vessel side wall facing opposite said first bathing vessel side wall, and said second wall comprises a bathing vessel back wall extending between said first and second bathing vessel side walls, and wherein said segmented sheet wall is collapsible into a shipping, handling, or storage position wherein one of said first and second bathing vessel side walls is bent around and underneath said bathing vessel back wall and the other of said first and second bathing vessel side walls is bent around and underneath the one of said first and second bathing vessel side walls such that both bathing vessel side walls and the bathing vessel back wall are in a stacked arrangement.

* * * * *